US007332957B2

(12) United States Patent
Hasegawa

(10) Patent No.: US 7,332,957 B2
(45) Date of Patent: Feb. 19, 2008

(54) CONSTANT CURRENT CIRCUIT

(75) Inventor: Kazuo Hasegawa, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 11/462,692

(22) Filed: Aug. 4, 2006

(65) Prior Publication Data

US 2007/0030055 A1 Feb. 8, 2007

(30) Foreign Application Priority Data

Aug. 5, 2005 (JP) ..... 2005-228701

(51) Int. Cl.
*G05F 1/10* (2006.01)
*G05F 3/02* (2006.01)

(52) U.S. Cl. ..... 327/543; 327/538; 327/103; 323/315; 323/316

(58) Field of Classification Search ..... 327/103, 327/538–543, 561–563; 323/315, 316
See application file for complete search history.

(56) References Cited

U.S. PATENT DOCUMENTS 5,059,890 A * 10/1991 Yoshikawa et al. ..... 323/315
5,680,348 A * 10/1997 Chung et al. ..... 365/185.23
5,774,013 A * 6/1998 Groe ..... 327/543
6,087,820 A * 7/2000 Houghton et al. ..... 323/315
7,176,753 B2 * 2/2007 Noda et al. ..... 327/543
7,208,931 B2 * 4/2007 Aota ..... 323/315

FOREIGN PATENT DOCUMENTS

JP 2000-227810 8/2000
JP 2004-120306 4/2004

* cited by examiner

*Primary Examiner*—Tuan T. Lam
*Assistant Examiner*—Patrick O'Neill
(74) *Attorney, Agent, or Firm*—SoCal IP Law Group LLP; Steven C. Sereboff; John E. Gunther

(57) ABSTRACT

A constant current circuit that generates a constant output current corresponding to an input voltage, comprises a differential amplifying unit to which the input voltage and a feedback voltage to be compared therewith are applied, the differential amplifying unit outputting a differential voltage, a first transistor with a first control electrode to which the differential voltage is applied, a first diode element that is connected to a power-supply side electrode of the first transistor, one or a plurality of second transistors that generates the output current, a feedback voltage conversion block that converts the duplicated current of the diode current flowing through the second transistor into the feedback voltage, and a constant current loading unit that is connected to a ground side electrode of the first transistor, the constant current loading unit making a voltage change in the ground side electrode follow a voltage change in the first control electrode.

3 Claims, 5 Drawing Sheets

CONSTANT CURRENT CIRCUIT

CROSS-REFERENCE TO RELATED APPLICATIONS

This application claims priority to Japanese Patent Application No. 2005-228701, filed Aug. 5, 2005, which is herein incorporated by reference.

BACKGROUND OF THE INVENTION

1. Field of the Invention

The present invention relates to a constant current circuit.

2. Description of the Related Art

FIG. 3 shows an example of a conventional constant current circuit (e.g., see FIG. 1 of Japanese Patent Publication No. 3423634). For example, the constant current circuit is employed for a circuit that generates a reference current of a variable gain amplifier (e.g., see Japanese Patent Application Laid-Open Publication No. 2004-120306).

A node OUT1 is a node between an output of an operational amplifier 13 and a gate electrode of an N-MOS transistor N6; a node out2 is a node between a resistance element R2 and a drain electrode of the N-MOS transistor N6; and a node OUT3 is a node between a drain electrode of a P-MOS transistor P5 and a resistance element R3.

An input voltage VIN is applied from an input terminal IN to a noninverting input terminal (+) of the operational amplifier 13, and a node voltage VOUT3 at the node OUT3 is applied to an inverting input terminal (−) thereof. An output voltage of the operational amplifier 13, that is, a node voltage VOUT 1 at the node OUT 1 is applied to the gate electrode of the N-MOS transistor N6. A power supply voltage VDD is applied to the source electrodes of the P-MOS transistors P5, P6, and a node voltage VOUT2 at the node OUT2 is applied to the gate electrodes thereof. The node voltage VOUT3 is applied to the drain electrode of the P-MOS transistor P5. The power supply voltage VDD is supplied to one terminal of the resistance element R2, and the node voltage VOUT2 is applied to the other terminal. The node voltage VOUT2 is applied to the drain electrode of the N-MOS transistor N6, and a ground voltage VSS is applied to the source electrode thereof.

In the above configuration, the operational amplifier 13 compares the input voltage VIN and the node voltage VOUT3 and applies the output voltage (node voltage VOUT1) corresponding to the difference to the gate electrode of the N-MOS transistor N6. The N-MOS transistor N6 sends a drain current Id corresponding to a gate-source voltage Vgs to the resistance element R2 so that a voltage drop occurs in the resistance element R2 (=R2×Id). As a result, the node voltage VOUT2 is developed at the node OUT2.

The node voltage VOUT2 is applied to the gate electrode of the P-MOS transistor P5. Therefore, P-MOS transistor P5 sends the drain current Id corresponding to the gate-source voltage Vgs to the resistance element R3 so that a voltage drop occurs in the resistance element R3 (=R3×Id). As a result, the node voltage VOUT3 is developed at the node OUT3, which is feed back to the inverting input terminal (−) of the operational amplifier 13.

The conventional constant current circuit shown in FIG. 3 uses the above series of operations to adjust the input voltage VIN and the node voltage VOUT3 to the same level. Since the gate electrode and the drain electrode can be controlled independently in the P-MOS transistors P5, the drain current thereof and the voltage drop in the resistance element R3 are not restrained. Therefore, as shown in FIG. 4, as the level of the input voltage VIN is increased, the level of the node voltage VOUT2 regulated by the voltage drop in the resistance element R2 is continuously reduced and, conversely, the level of the node voltage VOUT3 regulated by the voltage drop in the resistance element R3 is continuously increased. In this way, the voltage setting range of the input voltage VIN is equal to the operable range of the operational amplifier 13 and it is considered that a wide input voltage setting range can be ensured.

By the way, the present inventor has carried out a circuit simulation to validate operation of a constant current circuit 200 shown in FIG. 5 corresponding to the conventional constant current circuit shown in FIG. 3. FIGS. 6A and 6B show results of the simulation.

A differential amplifier 20 of the constant current circuit 200 shown in FIG. 5 corresponds to the operational amplifier 13, and a bias block 10 develops a bias for driving each transistor of a subsequent circuit such as the differential amplifier 20. An output current generating unit 30 is constituted by the resistance element R2 connected to the drain electrode of the N-MOS transistor N6 and the P-MOS transistors P5, P6 where the voltage drop in the resistance element R2 is applied to the gate electrodes and generates an output current Iout, which is a drain current of the P-MOS transistor P6. In a feedback voltage conversion block 60, the resistance element R3 is connected to the drain electrode of the P-MOS transistor P5, and the node voltage VOUT3 (feedback voltage) at the connecting potion thereof, i.e., the node OUT3 is fed back to the gate electrode of the N-MOS transistor N2 corresponding to the inverting input terminal of the operational amplifier 13.

FIG. 6A shows response waveforms of the node voltages VIN1 to 3 for the input voltage VIN and FIG. 6B shows a response waveform of the output current IOUT output from the output terminal OUT for the input voltage VIN.

As shown in FIG. 6A, when the input voltage VIN exceeds a predetermined threshold (when the input voltage VIN is near 0.90 V in the case of FIGS. 6A and 6B), The node voltages VOUT2, VOUT3 show characteristics that change electric potentials drastically and it can be seen that a linear control response as shown in FIG. 4 is not developed for the input voltage VIN. It can also be seen that the node voltage VOUT1 has a nonlinear control response as well. As a result, it can obviously be seen that the output current IOUT has a nonlinear control response as well.

The N-MOS transistor N6 and the P-MOS transistor P5 constitute a so-called two-stage amplification circuit and the input voltage and output voltage thereof are the node voltage VOUT1 and the node voltage VOUT3, respectively. This means that a high-gain two-stage amplification circuit is included in the feedback path of the differential amplifier 20. In the so-called Bode diagram, as a gain is increased, a phase margin (an index of how much margin exists until a phase becomes −180 degrees when a gain is 0 db) becomes insufficient correspondingly and, therefore, the output of the differential amplifier 20 may be oscillated unless appropriate phase compensation is performed.

In the countermeasures for avoiding the oscillation of the output of the differential amplifier 20, each gain of the N-MOS transistor N6 and the P-MOS transistor P5, i.e., each mutual conductance gm (a transfer characteristic indicating a relationship of the output current and the input voltage) may be reduced. The mutual conductance gm is generally expressed by the following equation (1). To reduce each gm of the N-MOS transistor N6 and the P-MOS transistor P5, each transistor size ratio (W/L) must be reduced.

$$gm=\Delta Id/\Delta Vgs=(W/L)\cdot\mu n\cdot Cox\cdot Vd \quad (1)$$

where L is a channel length; W is a channel width; Id is a drain current; μn is a mobility; Vgs is a gate-source voltage; and Cox is an electrostatic capacity of an oxide film.

For example, if the channel length L of each transistor is increased to reduce the transistor size ratio (W/L) of the N-MOS transistor N6 and the P-MOS transistor P5, the level must be increased in return in the gate voltage that should be applied to each gate electrode of the N-MOS transistor N6 and the P-MOS transistor P5. To increase the level of the gate voltage, the level of the power supply voltage VDD must be increased correspondingly. If each gm of the N-MOS transistor N6 and the P-MOS transistor P5 is reduced in this way, a high-level operational voltage is required for each transistor correspondingly and it may be problematic that the circuit does not operates unless the level of the power supply voltage VDD is also high. Operating a circuit built into an electronic device with a lower power supply voltage is the demands of the times not exclusively to the constant current circuit.

In the countermeasures for avoiding the oscillation of the output of the differential amplifier 20, the gain of the differential amplifier 20 itself may be reduced. In the constant current circuit 200 shown in FIG. 5, the resistance elements R4, R5 are disposed on the source electrode sides of a pair of the N-MOS transistors (N1, N2). However, since the resistance elements R4, R5 are disposed, the offset of the output of the differential amplifier 20 is increased by the voltages of the both ends of the resistance elements R4, R5, and the correction ability against the difference between two inputs is deteriorated in the differential amplifier 20. As the offset is increased, it becomes difficult to make the finally acquired output current IOUT of the output terminal OUT consistent with a predetermined set current. If the gain of the differential amplifier 20 itself is reduced by disposing the resistance elements R4, R5, the two-stage amplification circuit of the N-MOS transistor N6 and the P-MOS transistor P5 has the gain exceeding at least "1(0 dB)", the phase margin still tends to be insufficient. Therefore, if a parasitic capacity on the order of a few femto- to few tens of femto-farads (F) exists between the output of the differential amplifier 20 and the feedback input thereof, it is problematic that the oscillation may be induced.

SUMMARY OF THE INVENTION

In order to solve the above problem, according to a major aspect of the present invention there is provided a constant current circuit that generates a constant output current corresponding to an input voltage, comprising a differential amplifying unit to which the input voltage and a feedback voltage to be compared therewith are applied, the differential amplifying unit outputting a differential voltage between the input voltage and the feedback voltage, a first transistor with a first control electrode to which the differential voltage is applied, a first diode element that is connected to a power-supply side electrode of the first transistor, one or a plurality of second transistors that generates the output current duplicated from a diode current by applying to a second control electrode a voltage drop in the first diode element developed as a result of the diode current flowing through the first diode element due to drive of the first transistor, a feedback voltage conversion block that converts the duplicated current of the diode current flowing through the second transistor into the feedback voltage, which is fed back to the differential amplifying unit, and a constant current loading unit that is connected to a ground side electrode of the first transistor, the constant current loading unit making a voltage change in the ground side electrode follow a voltage change in the first control electrode, the constant current loading unit acting as a constant current load on the ground side of the first transistor.

The above and other aspects, features and advantages of the present invention will become more apparent from the following detailed description when taken in conjunction with the accompanying drawings.

BRIEF DESCRIPTION OF THE DRAWINGS

To understand the present invention and the advantages thereof more thoroughly, the following description should be referenced along with the accompanying drawings.

DETAILED DESCRIPTION OF THE INVENTION

From the contents of the description and the accompanying drawings, at least the following details will become apparent.

Figure 1:
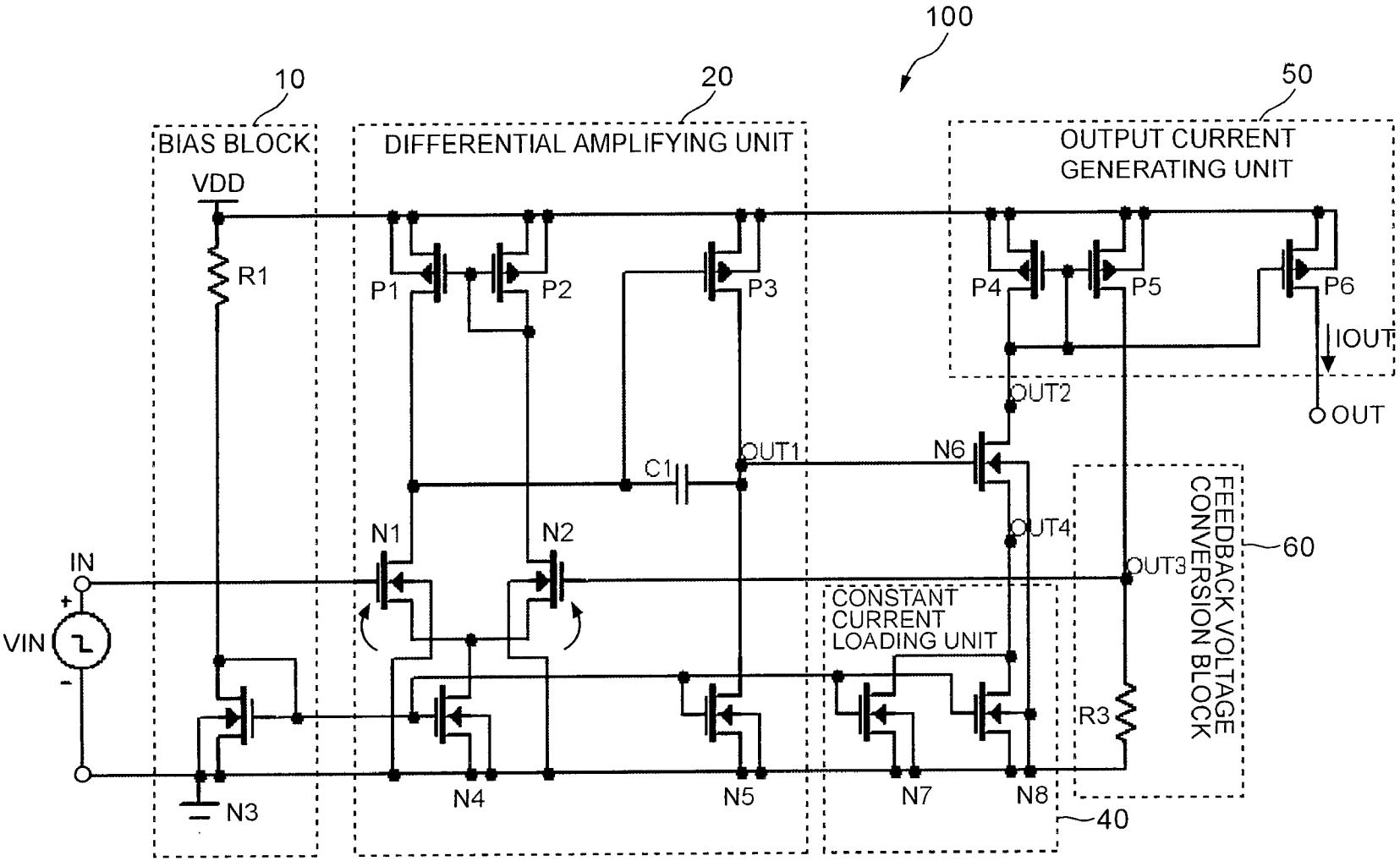
FIG. 1 shows a configuration of a constant current circuit according to one embodiment of the present invention.

FIG. 1 shows a configuration of a constant current circuit 100 according to the present invention. The same reference numerals are imparted to the same components as the constant current circuit 200 shown in FIG. 5.

A bias block 10 generates a bias voltage for driving each transistor constituting a subsequent circuit such as a differential amplifier 20. The bias block 10 is constituted by serially connecting a resistance element R1 and a so-called diode-connected (short-circuit of a drain electrode and a gate electrode) N-MOS transistor N3 between a power supply voltage VDD and a ground voltage VSS.

One end of the resistance element R1 toward the power supply voltage VDD is connected to each source electrode of P-MOS transistors P1 to P3 included in the differential amplifier 20 and P-MOS transistors P4 to P6 constituting an output current generating unit 50 to apply the power supply voltage VDD to each P-MOS transistors P1 to P6 of the subsequent stage.

On the other hand, the source electrode of the N-MOS transistor N3 is connected to each source electrode of N-MOS transistors N4, N5 included in the differential amplifier 20 and N-MOS transistors N7, N8 constituting an constant current loading unit 40 to apply the ground voltage VSS to each N-MOS transistors N4, N5, N7, N8 of the subsequent stage. The gate electrode of the N-MOS transistor N3 is in common connection with each gate electrode of each N-MOS transistors N4, N5, N7, N8 of the subsequent stage to constitute a so-called current mirror circuit. Therefore, the source current of the N-MOS transistor N3 is duplicated as the source current of each N-MOS transistors N4, N5, N7, N8 of the subsequent stage depending on a current mirror ratio based on a preset transistor size ratio.

In the differential amplifier 20, the input voltage VIN is applied to the gate electrode of the N-MOS transistors N1 ("control electrode of one transistor" according to the present invention) corresponding to an noninverting input terminal, and a node voltage VOUT3 ("feedback voltage" according to the present invention) to be compared with the input voltage VIN is applied to the gate electrode of the N-MOS transistor N2 (control electrode of the other transistor" according to the present invention) corresponding to an inverting input terminal. The differential amplifier 20 outputs a node voltage VOUT1, which is a voltage proportional to a difference between the input voltage VIN and the node voltage VOUT3 (=VIN−VOUT3).

In the circuit configuration of the differential amplifier 20 of the present invention, the N-MOS transistors N1, N2 in common connection with the source electrode constitute a differential transistor pair. Each drain electrode of the N-MOS transistors N1, N2 is connected to each drain electrode of the P-MOS transistors P1, P2 constituting the current mirror circuit. The current mirror circuit constituted by the P-MOS transistors P1 and P2 acts as a constant current source of each drain electrode of the N-MOS transistors N1, N2.

On the other hand, each source electrode of the N-MOS transistors N1, N2 is connected directly to the drain electrode of the N-MOS transistor N4. The N-MOS transistor N4 forms the current mirror circuit in combination with the diode-connected N-MOS transistor N3. Therefore, the N-MOS transistor N4 acts as a constant current source for the source electrodes of the N-MOS transistors N1, N2.

Since the combined current of the source electrodes of the N-MOS transistors N1, N2 is regulated by the constant current source of the N-MOS transistor N4, the currents flowing through the N-MOS transistors N1, N2 show a complementary relationship such that one current increases as the other current decreases. Consequently, the drain voltage of the N-MOS transistor N1 is changed depending on the level difference between the input voltage VIN and the NODE voltage VOUT3.

The serial connection of the P-MOS transistor P3 and the N-MOS transistor N5 constitutes a single-end output stage circuit of the differential amplifier 20. That is, the drain voltage of the N-MOS transistor N1 is applied to the gate electrode of the P-MOS transistor P3. Consequently, the output of the differential amplifier 20, i.e., the node voltage VOUT1 ("a differential voltage" according to the present invention) is developed at a node OUT1 established on a signal line between the P-MOS transistor P3 and the N-MOS transistor N5. A capacitor C1 is disposed between the node OUT1 and the gate electrode of the P-MOS transistor P3 for the phase compensation of the node voltage VOUT 1.

The output of the differential amplifier 20, i.e., the node voltage VOUT1 is applied to the gate electrode of the N-MOS transistor N6 ("a first control electrode of a first transistor" according to the present invention). That is, the N-MOS transistor N6 is driven by a gate-source voltage Vgs, which is a potential difference (=VOUT1−VOUT4) between the node voltage VOUT1 and a node voltage VOUT4 at a node OUT4 established at the source electrode side. The drain electrode of the N-MOS transistor N6 ("a power supply electrode of a first transistor" according to the present invention) is connected to the output current generating unit 50 and the source electrode thereof ("a ground electrode of a first transistor" according to the present invention) is connected to the constant current loading unit 40. A node OUT2 is established at the drain electrode side of the N-MOS transistor N6 and the node OUT4 is established at the source electrode side thereof.

The output current generating unit 50 generates a constant output current IOUT corresponding to the input voltage VIN. The feedback voltage conversion block 60 feeds back a voltage (node voltage VOUT3 described later) corresponding to the output current IOUT3 to the differential amplifier 20.

Figure 5:
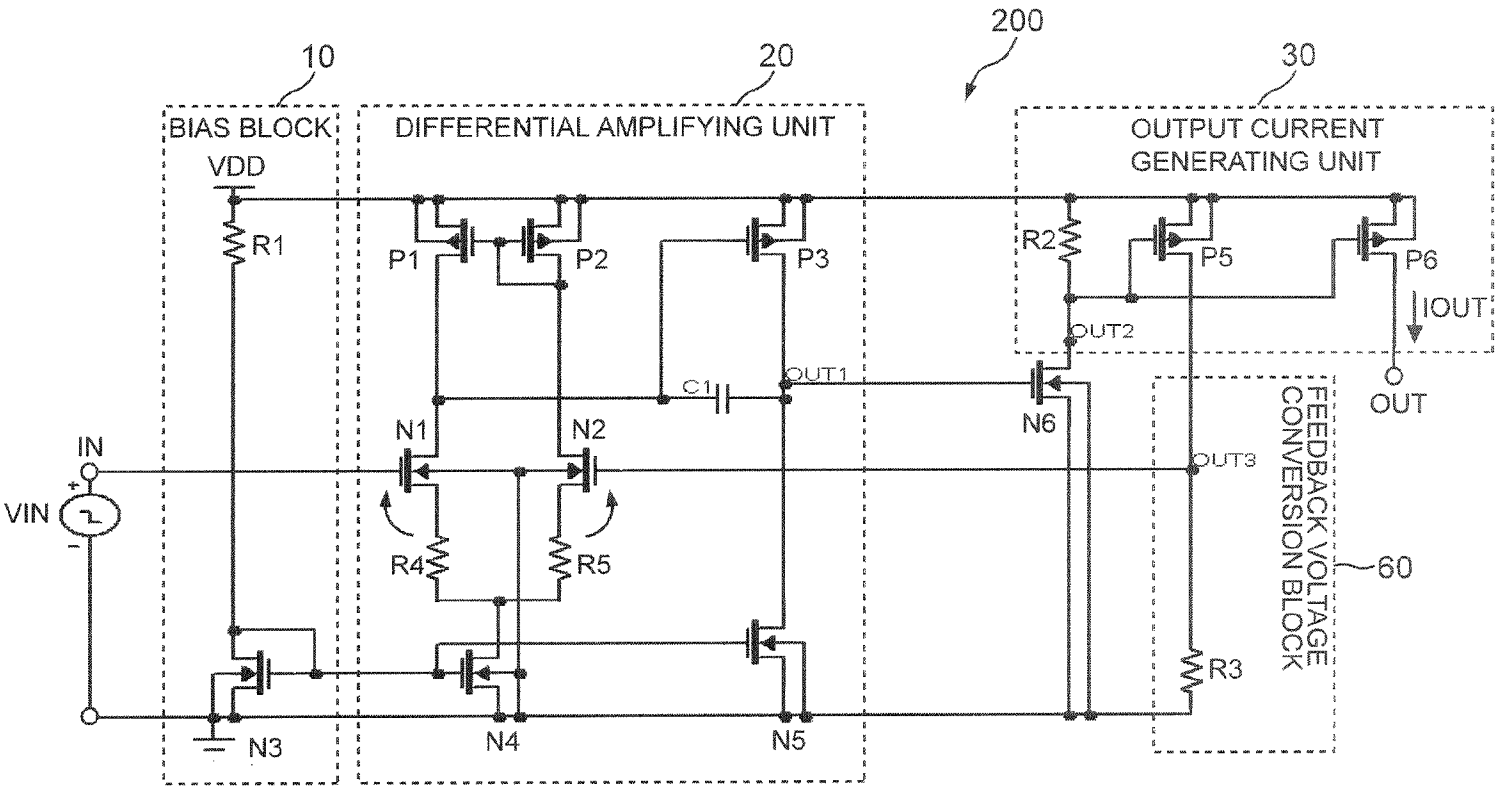
FIG. 5 PRIOR ART
FIG. 5 shows a detailed configuration for simulation of the conventional constant current circuit.

Specifically, in the output current generating unit 50, the resistance element R2 in the output current generating unit 30 of the constant current circuit 200 shown in FIG. 5 is replaced with the diode-connected P-MOS transistor P4 ("first diode element" according to the present invention). In the output current generating unit 50, the so-called current mirror circuit is constituted by common connection of the gate electrode of the P-MOS transistor P4 and each gate electrode of the P-MOS transistors P5, P6.

That is, the P-MOS transistor P4 has the drain voltage changed by the drive of the N-MOS transistor N6 and applies a current to itself depending on a relationship between the drain voltage and the source voltage (current voltage VDD). Since a voltage drop occurs consequently in the P-MOS transistor P4 and is applied to each gate electrode of the P-MOS transistors P5 and P6, a duplicated current duplicating the diode current of the P-MOS transistor P4 is applied to each of the P-MOS transistors P5, P6. Although the constant output current IOUT is acquired as the duplicated current from an output terminal OUT disposed in the drain electrode side of the P-MOS transistor P6 in this embodiment, the output current IOUT may be taken out from the drain electrode of the P-MOS transistor 5. The present invention is not limited to the three-stage current mirror circuit configuration of the P-MOS transistors P4, P5, and P6, a current mirror circuit configuration other than three stages may be employed.

In the feedback voltage conversion block 60, the drain electrode of the P-MOS transistor P5 is serially connected to the resistance element R3. Since the current flowing through the P-MOS transistor P5 also passes through the resistance element R3, a voltage drop occurs in the resistance element R3. Therefore, the node voltage VOUT3 is developed depending on the voltage drop in the resistance element R3 at a node OUT3 established on a signal line between the P-MOS transistor P5 and the resistance element R3. The node voltage VOUT3 is fed back to the gate electrode of the N-MOS transistor N2 of the differential amplifier 20.

Since the P-MOS transistors P4, P5, P6 constitute the current mirror circuit as described above, the diode current flowing through the P-MOS transistor P4 is duplicated as each current flowing through the P-MOS transistors P5, P6. Therefore, the current gain of the outout current generating unit 50 can be said to be "1 (0 dB)". Since the P-MOS transistor P4 acts as a general diode element, an approximately constant voltage drop (drain-source voltage) occurs which is determined by the transistor size ratio. Therefore, since the approximately constant gate voltage is applied to the gate electrodes of the P-MOS transistors P5 and P6, each mutual conductance gm of the P-MOS transistors P5 and P6 becomes constant as well.

In this way, in the output current generating unit 50, the P-MOS transistor P5 and the N1-MOS transistor N6 do not constitute a high high-gain two-stage amplification circuit as in the case of the conventional constant current circuit 200 shown in FIG. 5. Therefore, since the high-gain node voltage VOUT3 does not fed back to the differential amplifier 20 as in the case of the conventional constant current circuit 200 shown in FIG. 5, the oscillation of the output of the differential amplifier 20 is constrained.

As compared to the conventional constant current circuit 200 shown in FIG. 5, since the output current generating unit 50 constituting the current mirror circuit is employed, the voltage/current gain is reduced on the feedback path of the differential amplifier 20. Therefore, the gain of the differential amplifier 20 itself does not have to be reduced by disposing each resistance element R1, R2 between the differential transistor pair (N1, N2) and the N-MOS transistor N4, which is the constant current source, as in the case of the differential amplifier 20 of the conventional constant current circuit 200 shown in FIG. 5.

The constant current loading unit 40 has the N-MOS transistors N7, N8 constituting the current mirror circuit with the N-MOS transistor N3. In combination with the N-MOS transistor N6, the constant current loading unit 40 constitutes a so-called source follower where the change in the source voltage thereof follows the change in the gate voltage of the N-MOS transistor N6. Therefore, in the relationship between the node voltage VOUT1 corresponding to the gate voltage of the N-MOS transistor N6 and the node voltage VOUT4 corresponding to the source voltage thereof, the voltage gain is expressed by a ratio of the node voltage VOUT4 to the node voltage VOUT1 (=node voltage VOUT4/node voltage VOUT1), which ideally becomes "1 (0 dB)".

The aforementioned voltage gain of "1" means that the gate-source voltage Vgs of the N-MOS transistor N6 is constant. The mutual conductance gm of the N-MOS transistor N6 is generally expressed by "ΔId (change in drain current Id)/ΔVgs (change in gate-source voltage Vgs)". Since ΔVgs of the N-MOS transistor N6 is small, it can be derived from this expression that the mutual conductance gm of the N-MOS transistor N6 can be increased. That is, the gate voltage (node voltage VOUT1) for driving the N-MOS transistor N6 can be reduced and, consequently, it can be said that the entire constant current circuit 100 can be operated at a lower voltage.

Other than the current mirror circuit configuration of the embodiment, the constant current loading unit 40 may employ a constant current circuit utilizing a drain-source current Idss of a junction field effect transistor JFET, for example. However, if the current mirror circuit is employed for the constant current loading unit 40 as in the case of this embodiment, the constant current loading unit 40 can be achieved easily by utilizing the N-MOS transistor N3 of the bias block 10, which is essentially used for the differential amplifier 20.

Figure 2A:
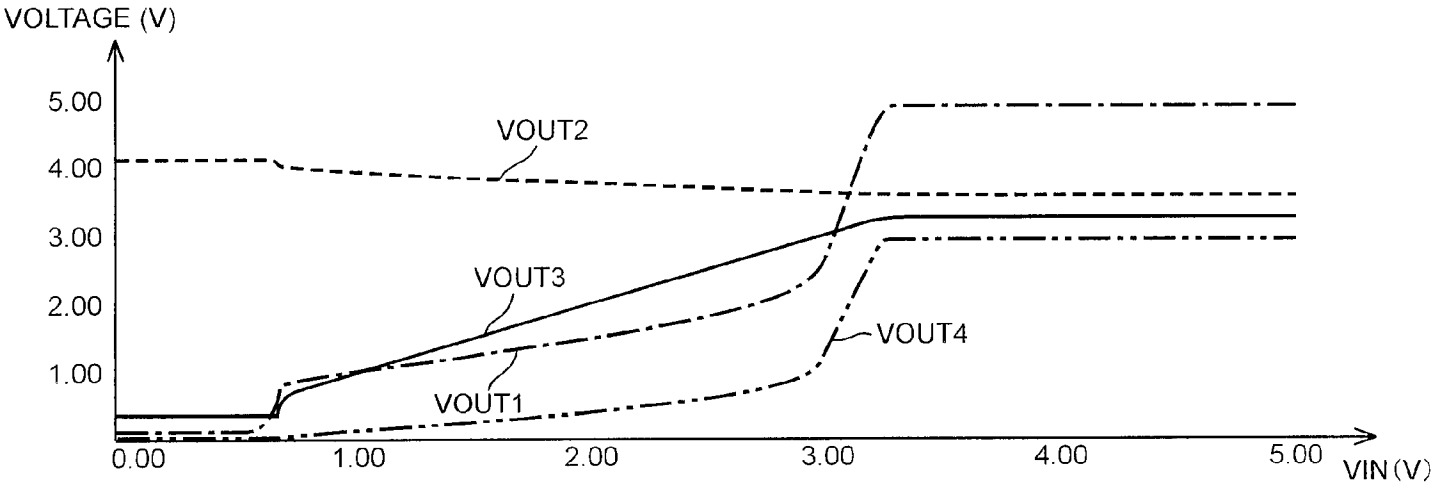
FIG. 2A shows a simulation waveform of each node voltage responding to an input voltage in the constant current circuit according to one embodiment of the present invention.
Figure 2B:
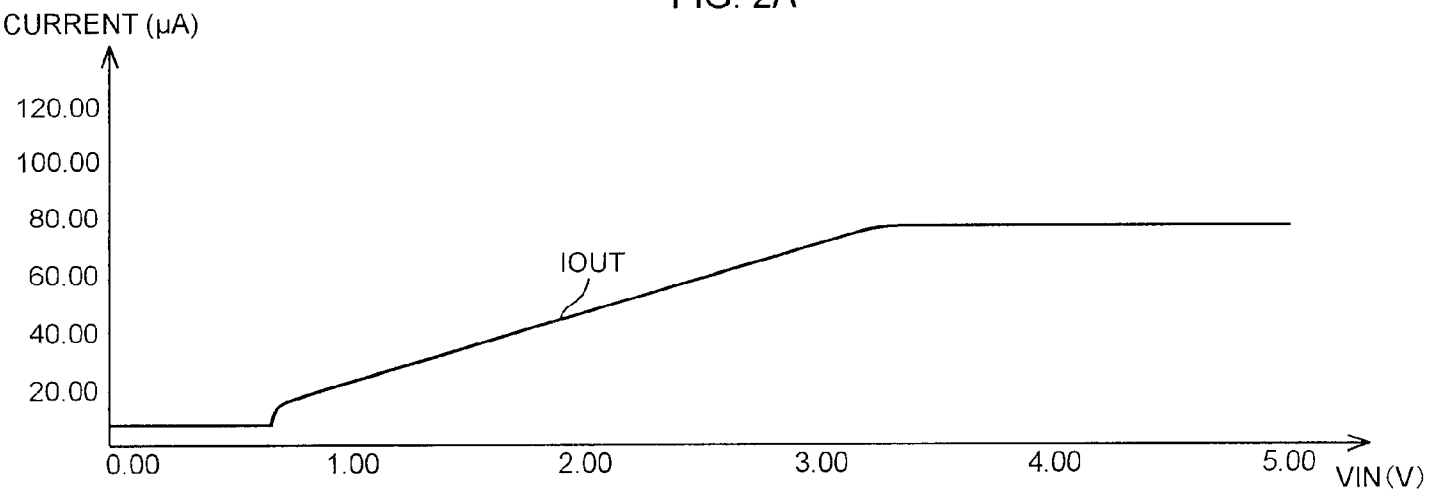
FIG. 2B shows a simulation waveform of an output current responding to the input voltage in the constant current circuit according to one embodiment of the present invention.
Figure 3:
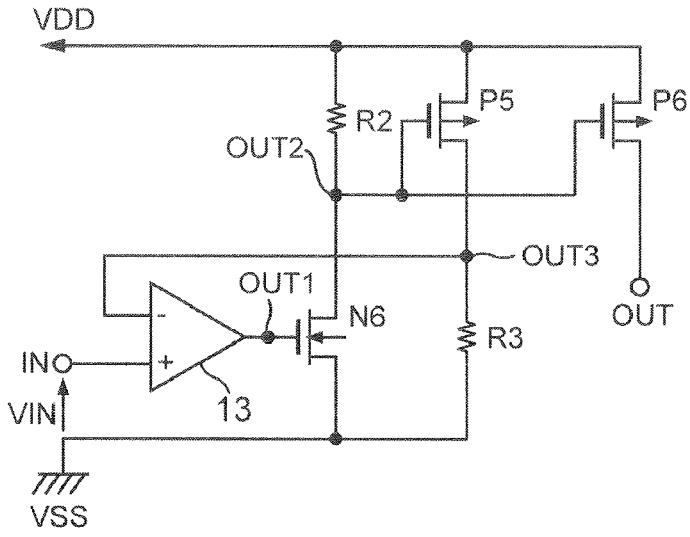
FIG. 3 PRIOR ART
FIG. 3 shows a configuration of a conventional constant current circuit.
Figure 4:
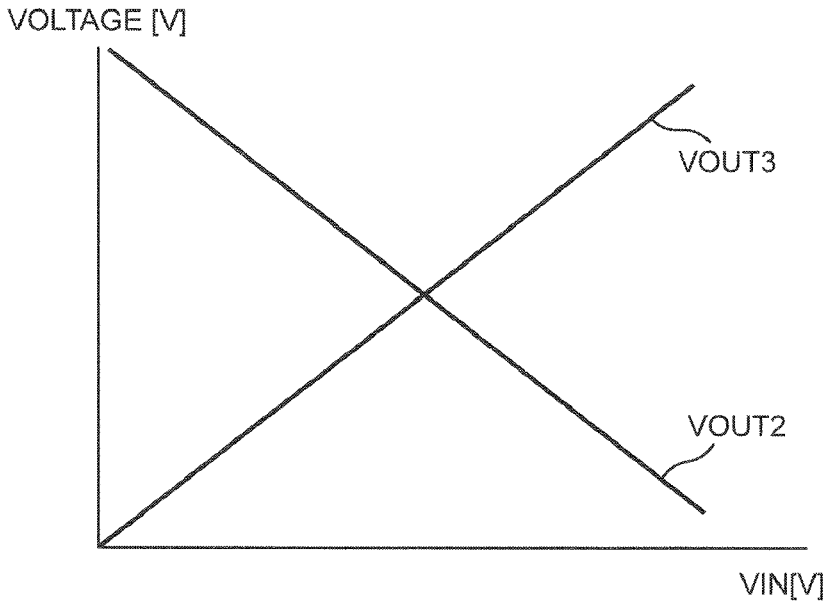
FIG. 4 PRIOR ART
FIG. 4 shows a waveform of each node voltage responding to the input voltage in the conventional constant current circuit.

FIG. 2A shows a simulation waveform of each node voltage responding to the input voltage VIN in the constant current circuit 100 and FIG. 2B shows a simulation waveform of the output current Iout responding to the input voltage VIN.

Figure 6A:
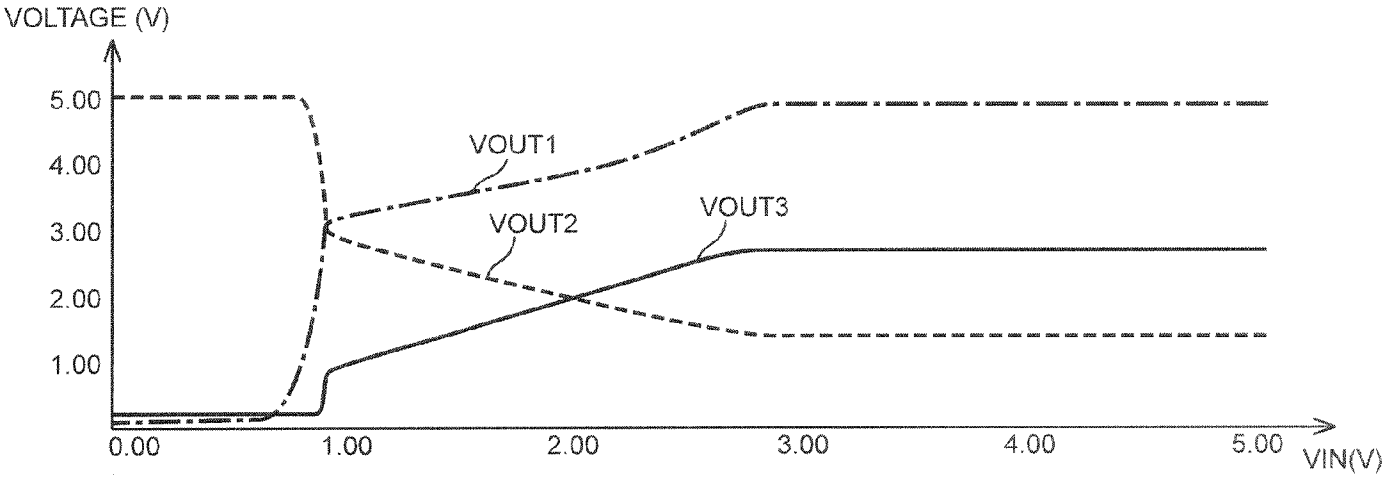
FIG. 6A PRIOR ART
FIG. 6A shows a simulation waveform of each node voltage responding to the input voltage in the conventional constant current circuit.
Figure 6B:
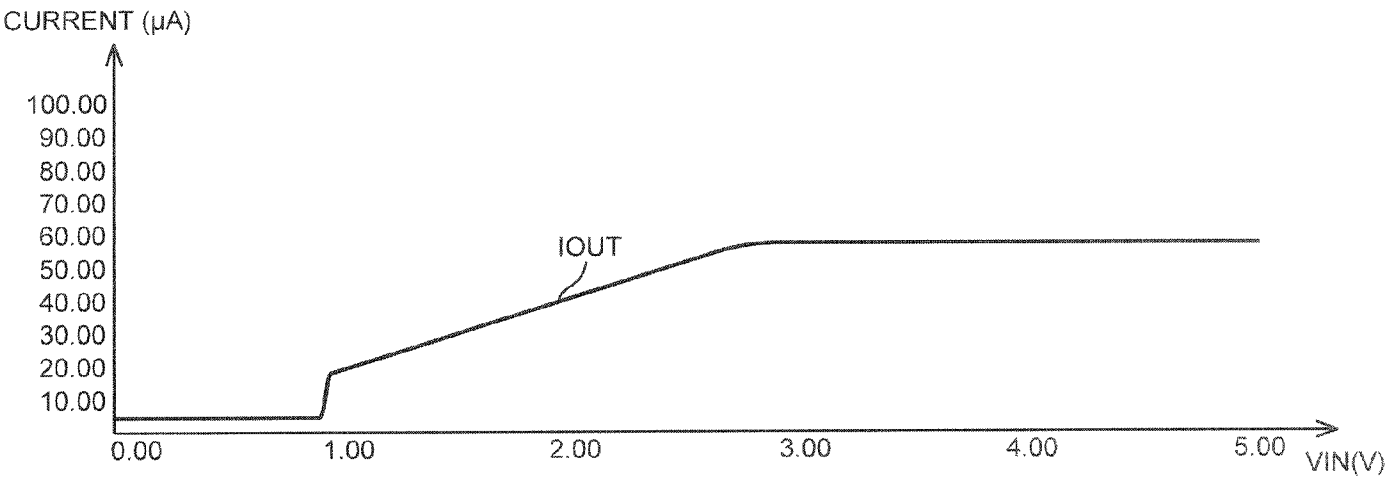
FIG. 6B PRIOR ART
FIG. 6B shows a simulation waveform of the output current responding to the input voltage in the constant current circuit.

As shown in FIG. 2A, it can be seen that the node voltages VOUT1 to 3 are constrained from becoming the nonlinear responses to the input voltage VIN and approach to the linear responses as compared to the conventional case shown in FIG. 6A. Consequently, as shown in FIG. 6B, it can be obviously seen that the output current TOUT is also constrained from becoming the nonlinear control response to the input voltage VIN and approaches to the linear response.

Although the embodiment of the present invention has been described hereinabove, the aforementioned embodiment is for the purpose of facilitating the understanding of the present invention and not for the purpose of construing the present invention in a limited manner. The present invention may be changed/altered without departing from the spirit thereof and encompasses the equivalents thereof.

What is claimed is:

1. A constant current circuit that generates a constant output current corresponding to an input voltage, comprising:

a differential amplifying unit to which the input voltage and a feedback voltage to be compared therewith are applied, the differential amplifying unit outputting a differential voltage between the input voltage and the feedback voltage;

a first transistor with a first control electrode to which the differential voltage is applied;

a first diode element that is connected to a power-supply side electrode of the first transistor;

one or a plurality of second transistors that generates the output current duplicated from a diode current by applying to a second control electrode a voltage drop in the first diode element developed as a result of the diode current flowing through the first diode element due to drive of the first transistor;

a feedback voltage conversion block that converts the duplicated current of the diode current flowing through the second transistor into the feedback voltage, which is fed back to the differential amplifying unit; and a constant current loading unit that is connected to a ground side electrode of the first transistor, the constant current loading unit making a voltage change in the ground side electrode follow a voltage change in the first control electrode, the constant current loading unit acting as a constant current load on the ground side of the first transistor.

2. The constant current circuit according to claim 1, wherein the constant current loading unit includes one or a plurality of third transistors as a constant current load, a duplicated current of a diode current of a second diode element flowing through the one or plurality of third transistors by applying to a third control electrode a voltage drop developed as a result of the diode current flowing through the second diode element.

3. The constant current circuit according to claim 1, wherein the differential amplifying unit includes a differential transistor pair, the input voltage being applied to a control electrode of one transistor of the differential transistor pair, the feedback voltage being applied to a control electrode of the other transistor of the differential transistor pair, ground side electrodes of the one and the other transistors of the differential transistor pair being connected in common, the differential transistor pair outputting a voltage applied to the one or the other transistor thereof as the differential voltage, and a constant current source that is connected directly to the ground side electrode of the differential transistor pair to flow a combined current of the differential transistor pair.

* * * * *